US009765516B2

(12) United States Patent
Van Dinther et al.

(10) Patent No.: US 9,765,516 B2
(45) Date of Patent: Sep. 19, 2017

(54) ACOUSTICALLY ABSORBING ROOM DIVIDER

(71) Applicant: PHILIPS LIGHTING HOLDING B.V., Eindhoven (NL)

(72) Inventors: Cornelus Hendricus Bertus Arnoldus Van Dinther, Eindhoven (NL); Ronaldus Maria Aarts, Eindhoven (NL); Gerben Kooijman, Eindhoven (NL); Okke Ouweltjes, Eindhoven (NL); Armin Gerhard Kohlrausch, Eindhoven (NL); Hendrikus Hubertus Petrus Gommans, Eindhoven (NL); Jasper Van Dorp Schuitman, Eindhoven (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

(21) Appl. No.: 15/036,071

(22) PCT Filed: Nov. 11, 2014

(86) PCT No.: PCT/EP2014/074289
§ 371 (c)(1),
(2) Date: May 12, 2016

(87) PCT Pub. No.: WO2015/071271
PCT Pub. Date: May 21, 2015

(65) Prior Publication Data

US 2016/0265214 A1 Sep. 15, 2016

(30) Foreign Application Priority Data

Nov. 18, 2013 (EP) ..... 13193296

(51) Int. Cl.
*E04B 1/82* (2006.01)
*G10K 11/172* (2006.01)

(52) U.S. Cl.
CPC ..... *E04B 1/8209* (2013.01); *G10K 11/172* (2013.01)

(58) Field of Classification Search
CPC ..... E04B 1/8209; G10K 11/172
(Continued)

(56) References Cited

U.S. PATENT DOCUMENTS 4,706,422 A * 11/1987 Ashton ..... E04B 2/7411 181/284
4,750,586 A * 6/1988 Lerner ..... E04B 1/8209 181/284
(Continued)

FOREIGN PATENT DOCUMENTS

GB 2482714 A 2/2012
JP 09078539 3/1997
(Continued)

OTHER PUBLICATIONS

A. Uris, et al., "Design of Lightweight Multilayer Partitions Based on Sonic Crystals", Appl. Phys. Lett. 79, 4453 (2001), 2 pages.
(Continued)

*Primary Examiner* — Forrest M Phillips

(57) ABSTRACT

A room divider (100) for dividing a room into two sub-portions (R1, R2) and for attenuating sound (S1, S2) travelling between the two sub-portions is provided. The room divider comprises hollow cylindrical elements (110) arranged periodically for dividing the room into the two sub-portions. At least some of the hollow cylindrical elements have a cylindrical shell (111) with at least one slit (112) extending in an axial direction (120) of the shell. The shell extends continuously along the perimeter of the cor-
(Continued)

responding hollow cylindrical element from one side (113) of the at least one slit to another side (114) of the at least one slit. Each of the at least one slit faces in a local elongation direction (130) of the room divider for increasing acoustic symmetry with respect to the two sub-portions. The use of destructive interference and resonance to attenuate sound allows for a less bulky/heavy acoustically absorbing room divider.

18 Claims, 5 Drawing Sheets

(58) Field of Classification Search
USPC ..... 181/295, 284, 286, 30
See application file for complete search history.

(56) References Cited

U.S. PATENT DOCUMENTS 6,367,581 B1 * 4/2002 Marler ..... B66B 11/0226 181/295
8,662,249 B2 * 3/2014 Nair ..... G10K 11/168 181/284
8,925,678 B2 * 1/2015 Tizzoni ..... E01F 8/0035 181/210
8,967,823 B2 * 3/2015 D'Antonio ..... E04B 9/32 362/147
2005/0098379 A1 * 5/2005 Sato ..... B60R 13/0815 181/293
2008/0135327 A1 6/2008 Matsumura et al.
2008/0164094 A1 * 7/2008 Magyari ..... G10K 11/20 181/295
2012/0090916 A1 4/2012 Berker et al.
2012/0152650 A1 * 6/2012 Swallowe ..... G10K 11/172 181/295
2014/0299408 A1 * 10/2014 Swinkels ..... G10K 11/172 181/289

FOREIGN PATENT DOCUMENTS

JP 2010085511 A 4/2010
JP 2010085511 A 4/2010
WO WO2010089351 A1 8/2010
WO WO2011048484 A1 4/2011
WO WO2012020239 A1 2/2012

OTHER PUBLICATIONS

I. Perez-Arjona, et al., "Theoretical Prediction of the Nondiffractive Propagation of Sonic Waves Through Periodic Acoustic Media", Physical Review B 75 (2007), pp. 014304-1 through 014304-7.
F. Koussa, et al., "Transport Noise Reduction by Low Height Sonic Crystal Noise Barriers", Proceedings of the Acoustics 2012 Nantes Conference, Apr. 23-27, 2012, Nantes, France, pp. 1003-1007.

* cited by examiner

ACOUSTICALLY ABSORBING ROOM DIVIDER

CROSS-REFERENCE TO PRIOR APPLICATIONS

This application is the U.S. National Phase application under 35 U.S.C. §371 of International Application No. PCT/EP2014/074289, filed on Nov. 11, 2014, which claims the benefit of European Application No. 13193296.4, filed on Nov. 18, 2013. These applications are hereby incorporated by reference herein.

FIELD OF THE INVENTION

The present invention generally relates to the field of acoustically absorbing room dividers.

BACKGROUND OF THE INVENTION

In open plan offices, people may have difficulties doing their job because of annoying and distracting sound around them. Such distraction may typically be caused by speech from other persons since in open plan offices speech may remain intelligible over large distances and may distract large groups of people. In order to reduce noise in open plan offices, acoustically absorbing/blocking room dividers may be placed between desks. Such room dividers may comprise acoustically absorbing materials and/or may have surface structures adapted for attenuating sound. However, a problem with existing room dividers is that they tend to be heavy and bulky. In particular, many existing room dividers are difficult move around in order to adapt to the need of acoustic attenuation in flexible open plan offices in which desks and work stations may be relocated. Hence, it would be desirable to provide more flexible and/or less bulky/heavy acoustically absorbing room dividers.

SUMMARY OF THE INVENTION

It would be advantageous to achieve a room divider overcoming, or at least alleviating, at least one of the above mentioned drawbacks. In particular, it would be desirable to provide more flexible and/or less bulky/heavy acoustically absorbing room dividers. To better address one or more of these concerns, a room divider having the features defined in the independent claim is provided. Preferable embodiments are defined in the dependent claims.

Hence, according to an aspect, a room divider for dividing at least a portion of a room into two sub-portions and for attenuating sound travelling between the two sub-portions is provided. The room divider comprises a plurality of hollow cylindrical elements arranged periodically for dividing the portion of the room into the two sub-portions. Each of the hollow cylindrical elements has a cylindrical shell with at least one slit extending in an axial direction of the cylindrical shell. The cylindrical shell extends continuously along the perimeter of the (corresponding) hollow cylindrical element (i.e. the hollow cylindrical element having the cylindrical shell) from one side of the at least one slit to another side of the at least one slit (i.e. from one side of a slit to the other side of the same slit, or from one side of a slit to one side of another slit). Each slit faces in a local elongation direction of the room divider. Additionally, the room divider comprises a light source arranged to emit light out of at least one of the hollow cylindrical elements. The light emitted by the light source may contribute to the illumination of a room in which the room divider is arranged. For example, the light emitted by the light source may be used to at least partially compensate for light emitted by light sources external to the room divider and obstructed by the room divider. The light source may for example be arranged to emit light out of an at least partially light transmissive hollow cylindrical element (or shell of a hollow cylindrical element).

The periodicity of the hollow cylindrical elements dividing the room (or at least a portion of the room) contributes to the attenuation of sound travelling between the two sub-portions by causing destructive interference of scattered sound waves. The at least some of the hollow cylindrical elements having a cylindrical shell with at least one slit extending in axial direction of the shell may allow resonance within the hollow cylindrical elements, which further contributes to the attenuation of sound travelling between the two sub-portions.

As mentioned above, in the room divider of the present invention the slits are facing in a "local elongation direction" of the room divider. Hereinafter, it will be further described what, in the context of the present invention, is meant with this particular technical feature.

The plurality of hollow cylindrical elements are arranged periodically to constitute a room divider in the form of a screen that can be used to divide a portion of a room into two sub-portion. In a direction perpendicular to its height, the room divider has an elongated cross section with an axis of elongation that can be a straight line (such as in the case of an oblong, rhomboidal or ellipsoidal cross section), or a curved line. For each hollow cylindrical element of the room divider, the slit is facing in a direction that is parallel to the axis of elongation at the location of that particular hollow cylindrical element. In the context of the present invention, this particular direction is referred to as the "local elongation direction" of the room divider.

Each of the at least one slit of a particular cylindrical shell faces in a local elongation direction of the room divider, but a first slit (of the at least one slit) of the particular cylindrical shell may for example face in a first local elongation direction of the room divider while an optional second slit (of the at least one slit) of the same particular cylindrical shell may face in a second local elongation direction of the room divider opposite (i.e. anti-parallel to) the first local elongation direction of the room. Further to the above, it is noted that according to the present invention none of the slits may face in a direction perpendicular to the local elongation direction at the corresponding hollow cylindrical element of the room divider (i.e. towards any one of the two sub-portions of the room).

The inventors have realized that attenuation caused by resonance in hollow cylindrical elements having slits facing (or directed towards) a sound source may be substantially maintained if the slits are redirected/rotated by about 90 degrees, i.e. if the slits instead face in local elongation directions of the room divider separating the sound source from a sub-portion of the room (i.e. if the slits are instead directed along the room divider). The inventors have further realized that acoustic symmetry of the room divider, with respect to the sub-portions on either side of the room divider, may be increased by directing the slits such that they face in local elongation directions of the room divider (i.e. by directing the slits along the room divider). In particular, a room divider in which the slits face in local elongation directions of the room divider may provide similar attenuation for sound travelling in both directions between the two sub-portions. The inventors have realized that such room dividers may be particularly useful in open plan offices in which attenuation is desired in both directions through the room divider.

The use of destructive interference and resonance to attenuate sound passing through the room divider reduces the amount of material needed to construct the room divider. Indeed, the hollow cylindrical elements need not be solid, allowing for use of hollow hollow cylindrical elements. Moreover, the hollow cylindrical elements need not be arranged adjacent each other forming a solid wall physically blocking sound waves (in contrast to traditional block-shaped room dividers), allowing for room dividers having space between the hollow cylindrical elements. Moreover, the use of destructive interference and resonance to provide attenuation reduces the need for acoustically absorbing materials and/or acoustically absorbing surfaces in the room divider and allows for use of a wider range of materials (such as e.g. light weight plastic hollow cylindrical elements). Hence, the present aspect allows for less bulky/heavy acoustically absorbing room dividers.

In addition, by allowing a construction with space between the hollow cylindrical elements of the room divider (as described above), air may be permitted to pass through the room divider, which may facilitate ventilation and/or heating of a room in which the room divider is arranged. Moreover, the reduced need for acoustically absorbing materials and/or acoustically absorbing surfaces in the room divider (as described above) allows for use of transparent materials in the hollow cylindrical elements, which may facilitate illumination of a room in which the room divider is arranged.

That the shell extends continuously along the perimeter of the corresponding hollow cylindrical element from one side of the at least one slit to another side of the at least one slit improves the acoustic attenuation caused by resonance in the hollow cylindrical element for at least some frequencies. Having such continuous unbroken portions of the shell (i.e. portions along the perimeter of the hollow cylindrical element free from any slit or opening) facing one or both of the sub-portions of the room improves the attenuation caused by resonance within the hollow cylindrical element for at least some frequencies.

By a slit (arranged along a shell of a hollow cylindrical element) facing in a particular direction it is meant that the opening defined by the slit is turned (or directed) towards a direction corresponding to (i.e. parallel to) a local elongation direction of the room divider. The slit may not necessarily be centered in the in the local elongation direction, but at least a portion of the opening defined by the slit may be directed towards the local elongation direction. However, in some embodiments, each of the at least one slit may be at least approximately centered in a local elongation direction of the room divider. In other words, each of the at least one slit may for example be centered at a direction from the center of the corresponding hollow cylindrical element which at least approximately corresponds to a local elongation direction of the room divider.

In some embodiments, each of the at least one slit may for example extend at most 90 degrees (preferably between 5 and 50 degrees) along the perimeter of the corresponding hollow cylindrical element (i.e. the hollow cylindrical element having the shell along which the at least one slit is arranged).

According to an embodiment, the shell may be arranged to extend continuously along the two portions of the perimeter of the hollow cylindrical element facing the two sub-portions. In the present embodiment, the portion of the perimeter of a hollow cylindrical element facing one of the two sub-portions of the room is a segment of the perimeter of the hollow cylindrical element corresponding to directions/angles substantially directed towards the sub-portion, i.e. a segment of the perimeter of e.g. at least 45 degrees (such as at least 90 degrees) centered at a direction transversal to (e.g. substantially orthogonal to) the room divider.

According to an embodiment, the at least one slit may include one slit and the shell may extend continuously from one side of the slit along a perimeter of the hollow cylindrical element (i.e. the hollow cylindrical element having the shell along which the first slit extends), to the other side of the slit, i.e. including along the two portions of the perimeter facing the two sub-portions of the room.

According to an embodiment, the at least one slit may include two slits facing in opposite local elongation directions of the room divider and the shell may extend continuously (on both sides of the room divider) between the two slits along the perimeter of the hollow cylindrical element, i.e. including along the two portions of the perimeter facing the two sub-portions of the room.

According to an embodiment, the hollow cylindrical elements may be are arranged in at least two (or three) rows. By increasing the number of rows of hollow cylindrical elements in the room divider, the amount of acoustic attenuation may be increased.

According to an embodiment, the hollow cylindrical elements may be spatially spaced from each other (e.g. by open space), i.e. consecutive/neighboring hollow cylindrical elements may be arranged at a distance from each other. In particular, air may be permitted to flow through the room divider from one of the two sub-portions of the room to the other sub-portion. By providing space between the hollow cylindrical elements, air may be permitted to flow between the hollow cylindrical elements and circulation of air in the room is enhanced, whereby ventilation and/or heating of the room is facilitated. With the present embodiment, design of ventilation and/or heating of the room may not necessarily be adapted to the actual location of the room divider and vice versa. By permitting air to flow through the room divider, the need for allowing air to pass on the side of (or above/below) the room divider is reduced. Hence, wider and/or taller room dividers may be used, which may allow for improved attenuation of sound.

According to an embodiment, the room divider may comprise straight passages between the hollow cylindrical elements, the passages extending between opposite sides of the room divider, and the passages being adapted to fluidly connect the sub-portions. Since the passages are straight and extend between opposite sides of the room divider, light may pass through the passages. Since the passages connect the two sub-portions of the room, light may pass through the room divider from one of the sub-portions to the other. By allowing light to pass through the room divider, illumination of the room is facilitated. For example, the design of the illumination of the room may not necessarily be adapted to the actual placement of the room dividers therein and vice versa. Moreover, since light may pass through the room divider, the sub-portion of the room on one side of the room divider may be at least partially visible through the room divider from the other side (e.g. from the other sub-portion of the room). In addition, by fluidly connecting the different sides of the room divider via the straight passages, air may be allowed to flow more freely through the room divider, which may facilitate ventilation and/or heating of the room.

According to an embodiment, the room divider may comprise a base with a cavity and an opening leading into the cavity. In the present embodiment, at least one of the hollow cylindrical elements may be arranged at the opening of the base in such a way that an interior of a shell of the at least one hollow cylindrical element (i.e. a volume on the inside of the shell) is acoustically connected to the cavity via the opening, i.e. such that resonance in the interior of the shell of the at least one hollow cylindrical element is interrelated with resonance in the cavity (or depends on the inner dimensions of the cavity). The acoustic attenuation caused by resonance in the interior of the shell of a hollow cylindrical element is typically strongest at a certain peak frequency. By acoustically connecting the interior of at least one hollow cylindrical element with the cavity, this peak frequency may be shifted towards lower frequencies. This may for example allow for a more efficient attenuation of human speech. The interior of the shell of the at least one hollow cylindrical element may for example be fluidly connected to the cavity via the opening, i.e. the at least one hollow cylindrical element may be arranged such that air may flow through the opening between the interior of the shell and the cavity.

According to an embodiment, the room divider may further comprise a rail, and at least some of the hollow cylindrical elements may be movably arranged along the rail. This may facilitate adaption of the room divider to changing needs of acoustic attenuation in a room in which the acoustic divider is arranged. For example, the acoustic room divider may be relocated and/or removed by sliding the hollow cylindrical elements along the rail, e.g. between desks in an office.

In some embodiments, the room divider may comprise at least one actuator (e.g. one or more motors or a motorized system) for moving the hollow cylindrical elements along the rail. The at least one actuator may be arranged to shift the room divider between an extended state in which the hollow cylindrical elements are interspaced by at least a first distance, and a retracted state in which the distance between at least some of the hollow cylindrical elements is less than the first distance. For example, the room divider may be shifted between a retracted state in which it occupies relatively little space, and an extended state in which it is adapted to attenuate sound more efficiently but in which it also occupies more space.

In some embodiments, the room divider may comprise a coupling element (such e.g. a base plate on which the hollow cylindrical element are mounted or a string, cord or wire) interconnecting two or more of the movably arranged hollow cylindrical elements for maintaining a maximum distance between the two or more hollow cylindrical elements during displacement along the rail. In other words, two or more of the hollow cylindrical elements may be prevented by the coupling element from sliding further apart than a maximum distance during displacement along the rail. The coupling element may facilitate periodic arrangement of the hollow cylindrical elements during and/or after displacement along the rail.

According to an embodiment, at least some of the hollow cylindrical elements (having cylindrical shells) may have at least one inner shell arranged concentrically to the cylindrical shell. This concentric shape of the hollow cylindrical elements allows for resonance in spaces/volumes between the different concentric shells. The dimensions/shapes of the concentric shells may be used to at least partially tune the attenuation caused by resonance.

In some embodiments, the at least one inner shell may be cylindrical and may have at least one slit extending along the at least one inner shell in the axial direction. In the present embodiment, the at least one slit of the at least one inner shell may face in a local elongation direction of the room divider (e.g. in the same direction(s) as the at least one slit of the outer cylindrical shell).

According to an embodiment, at least one of the hollow cylindrical elements may be at least partially light transmissive, i.e. configured to allow at least some light to pass through at least a portion of the at least one hollow cylindrical element. By allowing light to pass though at least one hollow cylindrical element, illumination of a room in which the room divider is arranged may be less obscured by the room divider and/or visibility through the room divider may be increased.

According to an embodiment, the at least one light source may include one or more light sources arranged at an end of one of the hollow cylindrical elements and adapted to emit light towards an interior of the one of the hollow cylindrical elements. The light may then be coupled out from the hollow cylindrical element by one or more optical structures of the hollow cylindrical element (such as total internal reflection, TIR, scattering or prism structures in the hollow cylindrical element). Light sources arranged at the ends of the hollow cylindrical elements (as compared to light sources arranged along the hollow cylindrical elements) may be less visible for persons looking towards or through the room divider. This may for example increase visibility through the room divider hollow cylindrical elements (as compared to light sources arranged along the hollow cylindrical elements), e.g. when the light sources are switched off. The at least one light source may for example be arranged in the floor/ceiling, in a base element on which the hollow cylindrical elements are mounted, or hidden behind a bezel.

According to an embodiment, the at least one light source may include a strip of light sources arranged along the axial direction in an interior of a shell of one of the hollow cylindrical elements. The use of a strip of light sources in a hollow cylindrical element may facilitate provision of a more uniform illumination along the hollow cylindrical element. Light from a strip of light sources may for example be diffused by a diffusing element and may be used to provide an intense luminescent surface along which light from the individual light sources may not be identified.

According to an embodiment, at least some of the hollow cylindrical elements may be at least partially light transmissive and at least partially diffusive such that visibility through the room divider is controllable by adjusting light emitted by the at least one light source. When the light source(s) are switched off, a sub-portion of a room may be at least diffusely visible through the room divider. When the light sources are switched on, light from the light sources may be diffused and/or scattered by the hollow cylindrical elements such that it is distributed across at least part of the room divider. If high enough illumination levels are used for the light sources, the light from the light sources may reduce visibility through the room divider, e.g. it may cause the scene behind the room divider to become practically invisible through the room divider. Control of visibility though a room divider may be particularly useful for room dividers in rooms where visual privacy is important.

In some example embodiments, an interior surface of the cylindrical shells of at least some of the hollow cylindrical elements may be adapted to diffuse light. By using the interior surfaces of the hollow cylindrical elements to diffuse light, the outer surfaces of the hollow cylindrical elements may be designed based on desired acoustic properties. For example, the outer surfaces of the hollow cylindrical elements may be made smooth to improve acoustic attenuation caused by destructive interference between scattered sound waves.

It is noted that embodiments of the invention relates to all possible combinations of features recited in the claims.

BRIEF DESCRIPTION OF THE DRAWINGS

This and other aspects will now be described in more detail with reference to the appended drawings showing embodiments.

All the figures are schematic, not necessarily to scale, and generally only show parts which are necessary in order to elucidate the embodiments, wherein other parts may be omitted or merely suggested. Like reference numerals refer to like elements throughout the description.

DETAILED DESCRIPTION OF THE EMBODIMENTS

Figure 1:
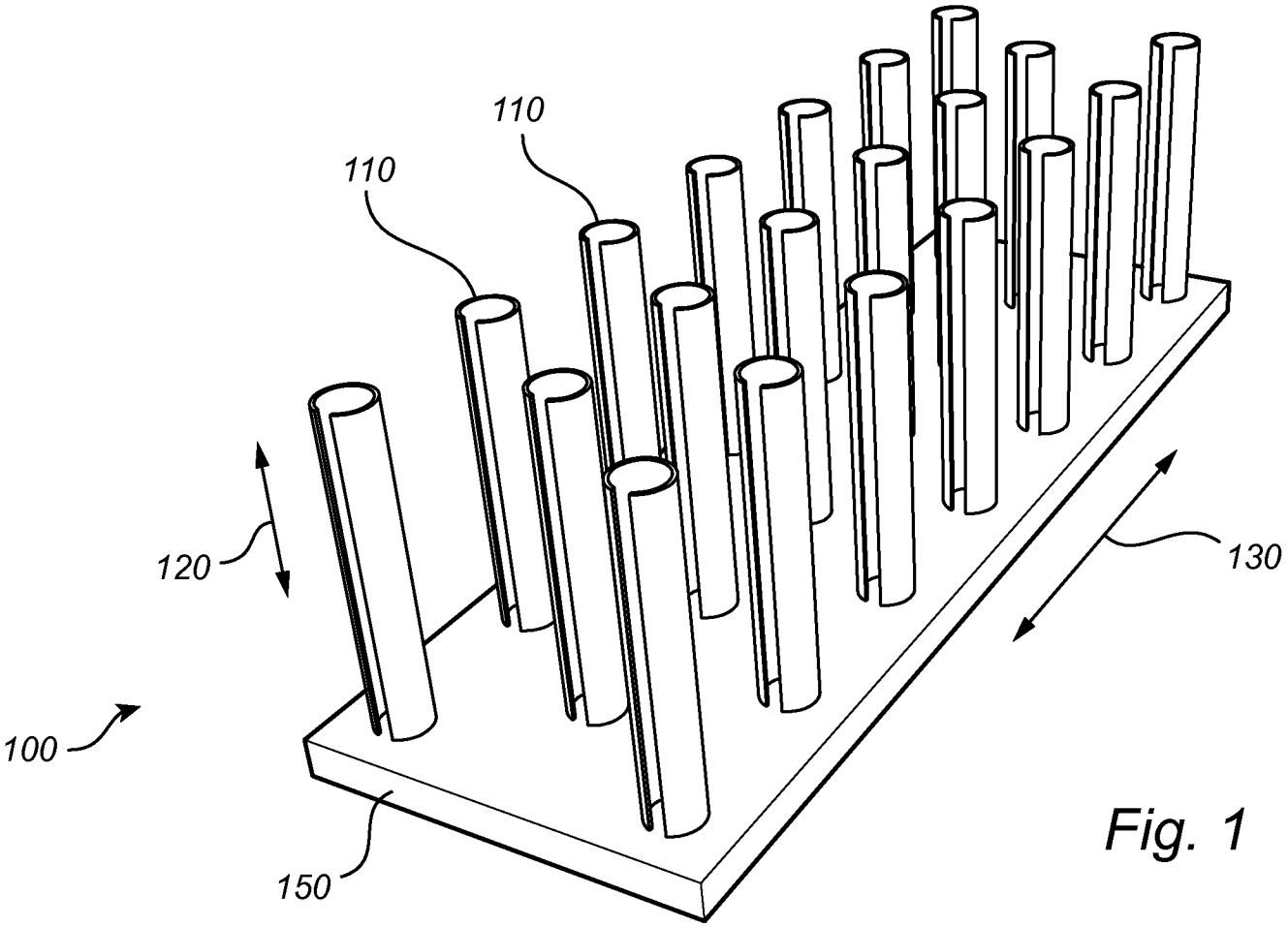
FIG. 1 is a perspective view of a room divider according to an embodiment.

The present aspect will now be described more fully hereinafter with reference to the accompanying drawings, in which currently preferred embodiments are shown. This invention may, however, be embodied in many different forms and should not be construed as limited to the embodiments set forth herein; rather, these embodiments are provided for thoroughness and completeness, and fully convey the scope of the present aspect to the skilled person.

A room divider according to an embodiment will be described with reference to FIGS. 1 and 2. The room divider 100 is adapted to divide at least a portion of a room into two sub-portions R1, R2, and is adapted to attenuate sound S1, S2 travelling between the two sub-portions R1, R2. The room divider 100 comprises a plurality of hollow cylindrical elements 110 arranged periodically for dividing the portion of the room into the two sub-portions R1, R2. At least some of the hollow cylindrical elements 110 have a cylindrical shell 111 (see the enlarged portion of FIG. 2) with at least one slit 112 extending in an axial direction 120 of the shell 111. The shell 111 extends continuously along the perimeter of the corresponding hollow cylindrical element 110 from one side 113 of the at least one slit 112 to another side 114 of the at least one slit 112. Each of the at least one slit 112 faces in a local elongation direction 130 of the room divider 100.

Figure 2:
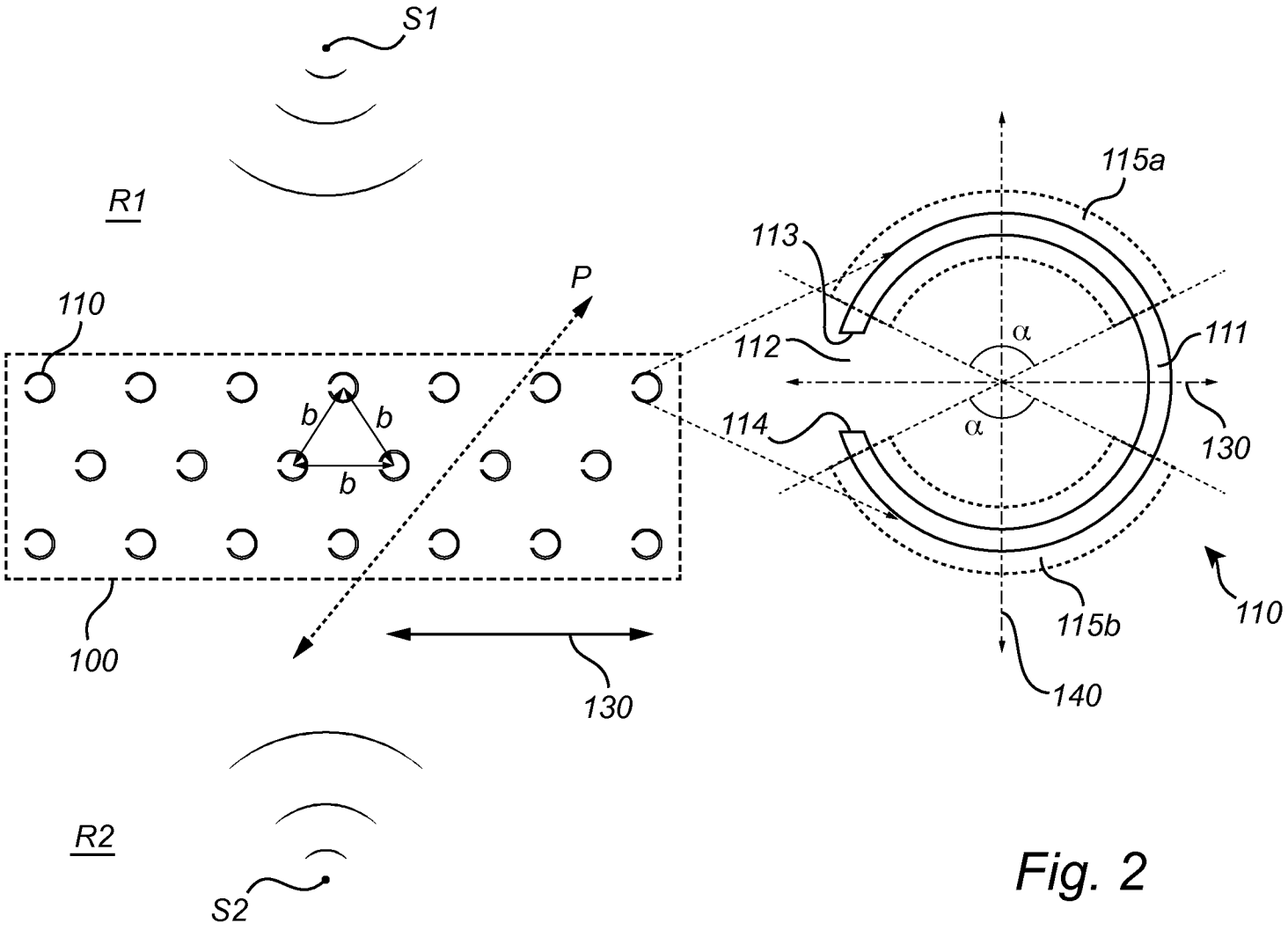
FIG. 2 shows a top view of a room divider depicted in FIG. 1.
Figure 3:
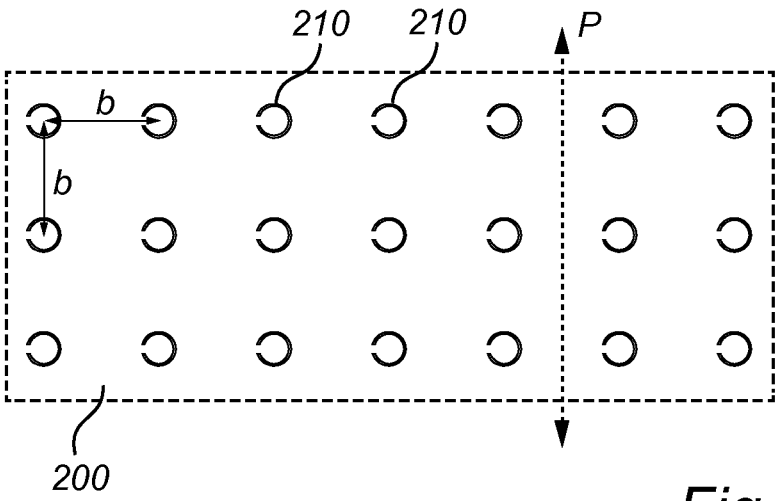
FIG. 3 shows a top view of a room divider according to another embodiment.

In FIGS. 1 and 2, the plurality of hollow cylindrical elements 110 is exemplified by three substantially parallel rows of vertical hollow cylindrical elements 110 arranged along a horizontal direction separating the two sub-portions R1, R2 of the room. The rows of hollow cylindrical elements 110 are arranged to form a triangular lattice with lattice constant b, i.e. the distance between adjacent hollow cylindrical elements 110 has a constant value b both along the rows and between the different rows. An alternative arrangement of the hollow cylindrical elements is depicted in FIG. 3, showing a room divider 200 comprising three rows of vertical hollow cylindrical elements 210 arranged in a square lattice with lattice constant b, i.e. in which the distance between adjacent hollow cylindrical elements 210 has a constant value b. The periodic arrangement of hollow cylindrical elements 110, 210 shown in FIGS. 1, 2 and 3 are examples of so-called sonic crystals.

Other periodic arrangements of hollow cylindrical elements 110 are also envisaged. For example, the hollow cylindrical elements 110 may be arranged in any number of rows (preferably at least two rows). In another example, the hollow cylindrical elements 110 may be horizontal and may be arranged periodically along a vertical direction so as to divide the room into the two sub-portions R1, R2. Alternatively, the hollow cylindrical elements 110 may extend axially in a diagonal direction (i.e. neither horizontal nor vertical). In such an example embodiment, the axial direction of the hollow cylindrical elements 110 together with the direction along which the hollow cylindrical elements 110 are arranged and/or distributed divides the room into the two sub-portions R1, R2. Embodiments may also be envisaged in which the room divider comprises standing hollow cylindrical elements which are tilted in a direction towards one of the two sub-portions R1, R2.

The periodic arrangement of the hollow cylindrical elements 110 in FIG. 2 (and similarly the hollow cylindrical elements 210 in FIG. 3) causes destructive interference between sound waves scattered by the hollow cylindrical elements 110. As a result of this destructive interference, sound passing through the room divider 100 is attenuated. The attenuation is greatest for frequencies around attenuation peaks (also called Bragg gaps) predicted by Bragg's law $$n\lambda=2b\sin(\theta),$$

where n is an integer, λ is the wavelength of the incident sound wave, b is the lattice constant (i.e. the distance between adjacent hollow cylindrical elements 110) and θ is the angle of incidence of the sound wave relative to the room divider 100. Hence, attenuation at a desired frequency may be achieved by choosing the lattice constant b appropriately. With regard to office environments, interesting sounds to attenuate are speech and low frequency noises, such as printer noise. These sounds have most of their energy in the frequency range of 300 Hz to 3000 Hz. Therefore, the lattice constant b may preferably be larger than 6 cm and smaller than 20 cm. The Bragg gap for a lattice constant b of 20 cm appears around 850 Hz, but attenuation of lower frequencies may be achieved in combination with other effects, such as resonance, as described below.

With reference again to FIGS. 1 and 2, each of the hollow cylindrical elements 110 has a cylindrical shell 111 (with a radius of e.g. 1 to 10 centimeters) with a slit (or opening) 112 extending in the axial direction 120 of the shell 111. The slit 112 faces in a local elongation direction 130 of the room divider 100, i.e. it faces along the rows of hollow cylindrical elements 110 in the room divider 100, not towards sound the sources S1, S2 in the two sub-portions R1, R2 of the room. In other words, the hollow cylindrical elements 110 are arranged periodically along a first direction (the direction along the three rows indicated by arrow 130 in FIGS. 1 and 2) transversal to the axial direction 120 of the hollow cylindrical elements 110, and the slit 112 faces along a plane spanned by the first direction 130 and the axial direction 120 of the hollow cylindrical elements 110. In particular, the slit 112 is directed such that it faces away from the two sub-portions R1, R2 of the room.

Alternative embodiments may be envisaged, in which only some of the hollow cylindrical elements 110 have cylindrical shells 111 with slits 112, and/or where the slits 112 of some hollow cylindrical elements 110 face in one direction along the room divider 100 while the slits 112 of other hollow cylindrical elements 110 face in the opposite direction along the room divider 100.

The slit 112 may for example extend at most 90 (or at most 45) degrees along a perimeter of the hollow cylindrical element 110. The slit 112 may for example be a void gap without anything covering the slit 112. Alternatively, the slit 112 may for example be at least partially covered by a perforated plate or and/or an elastic membrane.

The slit 112 faces in a local elongation direction 130 of the room divider 100, i.e. the slit 112 extend across directions from the center of the hollow cylindrical element 110 including a direction corresponding to (i.e. parallel to) a local elongation direction 130 of the room divider 100. The slit 112 may for example correspond to a sector along the perimeter of the hollow cylindrical element 110 at least approximately centered at a direction from the center of the hollow cylindrical element 110 parallel to a local elongation direction 130 of the room divider 100.

In FIG. 2, the perimeter of each hollow cylindrical element 110 is circular and includes two portions 115*a-b*, each facing (or being directed towards) one of the two sub-portions R1, R2 of the room. Such a portion 115*a* (or 115*b*) of the perimeter is a segment of the perimeter of the hollow cylindrical element 110 with a central angle $\alpha$ of e.g. at least 45 degrees (or at least 90 degrees) and centered at a direction transversal to (e.g. substantially orthogonal to) the room divider 100 as indicated by arrow 140. The shell 111 extends continuously from one side 113 of the slit 112 along a perimeter of the hollow cylindrical element 110 to the other side 114 of the slit 112, i.e. the shell 111 is C-shaped and may extend without interruption to cover all angles along the perimeter of the hollow cylindrical element 110 except those corresponding to the slit 112. In particular, the shell 111 extends continuously along the two portions 115*a-b* of the perimeter of the hollow cylindrical element 110 facing the two sub-portions R1, R2.

The hollow cylindrical elements 110 having shells 111 with slits 112 contribute to the attenuation of sound via resonance in the interior of the hollow cylindrical elements 110. These hollow cylindrical elements 110 act as Helmholtz resonators and the frequencies at which the resulting acoustic attenuation is provided may be adapted by adapting the dimensions of the interior of the hollow cylindrical elements 110. The attenuation caused by resonance is substantially independent of the periodicity of the hollow cylindrical elements 110. Hence, the total attenuation provided by the room divider 100 for different frequencies may be adapted by more or less independently adapting the attenuation caused by destructive interference and the attenuation caused by resonance. In particular, resonance may be used to provide attenuation for frequencies below the Bragg gap caused by destructive interference.

By arranging the slits 112 to face along the room divider 100 (i.e. to face in a local elongation direction 130 of the room divider 100), the attenuation caused by resonance in the hollow cylindrical elements is (at least approximately) symmetric with respect to the sound S1 travelling from the first sub-portion R1 of the room towards the second sub-portion R2 of the room and the sound S2 travelling in the opposite direction. In other words, the attenuation provided by resonance in the hollow cylindrical elements 110 is (at least approximately) the same for sound passing in both directions through the room divider 100.

The continuous C-shape of the shell 111 (as compared to shells with additional openings along the perimeter of the hollow cylindrical element 110) may increase attenuation caused by resonance in the hollow cylindrical element 110 for at least some frequencies. Continuous unbroken portions of the shell 111 (as compared to portions with further slits/openings in addition to those facing along the room divider 100) improves the attenuation caused by resonance within the hollow cylindrical element 110 for at least some frequencies, e.g. frequencies of human speech.

Figure 4:
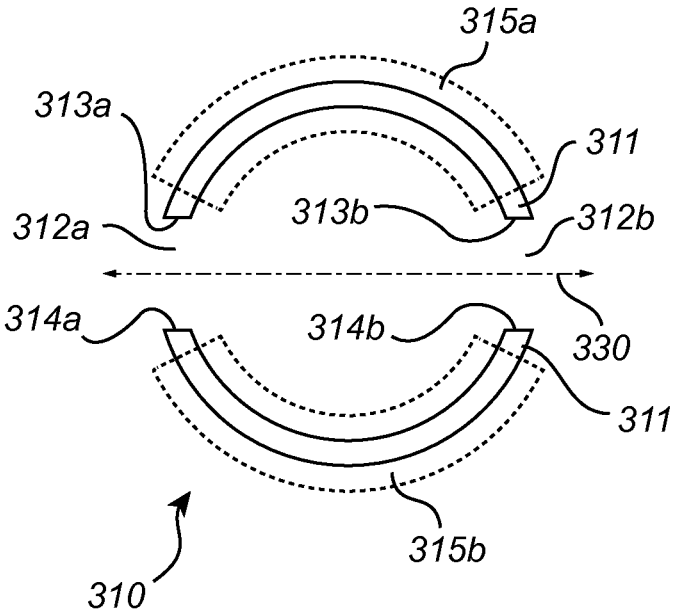
FIGS. 4 to 6 show cross sections of hollow cylindrical elements for use in room dividers according to different embodiments.

FIG. 4 shows an embodiment in which the shell 311 of a hollow cylindrical element 310 has two slits 312*a-b* facing in opposite local elongation directions 330 of the room divider (the slits 312*a-b* may for example extend at most 90 (or at most 45) degrees along a perimeter of the hollow cylindrical element 310). Such hollow cylindrical elements 310 may for example be used in the room dividers 100, 200 described with reference to FIGS. 1, 2 and 3, as an alternative or complement to the hollow cylindrical elements 110, 210 depicted therein. The shell 311 of the hollow cylindrical element 310 depicted in FIG. 4 extends continuously on both sides of the room divider, from the first slit 312*a* along the perimeter of the hollow cylindrical element 310 to the second slit 312*b*. I.e., the shell 311 extends without interruption to cover all angles along the perimeter of the hollow cylindrical element 310 except those corresponding to the slits 312*a-b*. Hence, similarly to the hollow cylindrical elements 110 described with reference to FIG. 2, the perimeter of the hollow cylindrical element 310 is circular and includes two portions/segments 315*a-b*, each facing one of the two sub-portions into which the room has been divided by the room divider. The shell 311 extends continuously from one side 313*a* of the first slit 312*a* along a perimeter of the hollow cylindrical element 310 to one side 313*b* of the second slit 312*b*, and thereby extends continuously along the portion 315*a* of the perimeter of the shell 310 facing one of the two sub-portions of the room. Similarly, the shell 311 extends continuously from the other side 314*a* of the first slit 312*a* along a perimeter of the hollow cylindrical element 310 to the other side 314*b* of the second slit 312*b*, and thereby extends continuously along the portion 315*b* of the perimeter of the shell 310 facing the other of the two sub-portions of the MOM.

That the shells 111, 311 in FIGS. 2 and 3 extend continuously along a certain portion of the perimeter of the hollow cylindrical elements 110, 310 means that they cover (substantially) all angles along this portion and, not necessarily that the inner and/or outer surfaces of the shells 111, 311 are continuous/smooth. In particular, the shell 111, 311 need not be formed in one piece. For example, embodiments may be envisaged in which the shell 111, 311 may be made from several parts combined/assembled to form the shell 111, 311.

With reference in particular to FIG. 2, the hollow cylindrical elements 110 may be spatially spaced from each other (by free space). The room divider 100 comprises straight passages P between the hollow cylindrical elements 110. The passages P extend between opposite sides of the room divider 100 and fluidly connect the sub-portions R1, R2 of the room, i.e. air is permitted to pass through the passages P. Illumination, ventilation and/or heating of a room divided by the room divider 100 may be facilitated by allowing air and/or light to pass though the room divider 100 via the passages P. Illumination and/or visibility through the room divider may for example be further facilitated by the use of transparent hollow cylindrical elements 110.

The example of a triangular lattice of hollow cylindrical elements 110 in the room divider 100 provides open passages P directed diagonally through the room divider 100. The example of a square lattice of hollow cylindrical elements 210 in the room divider 200, as depicted in FIG. 3, provides open passages P through the room divider 200 directed orthogonally relative to the room divider 200.

Figure 5:
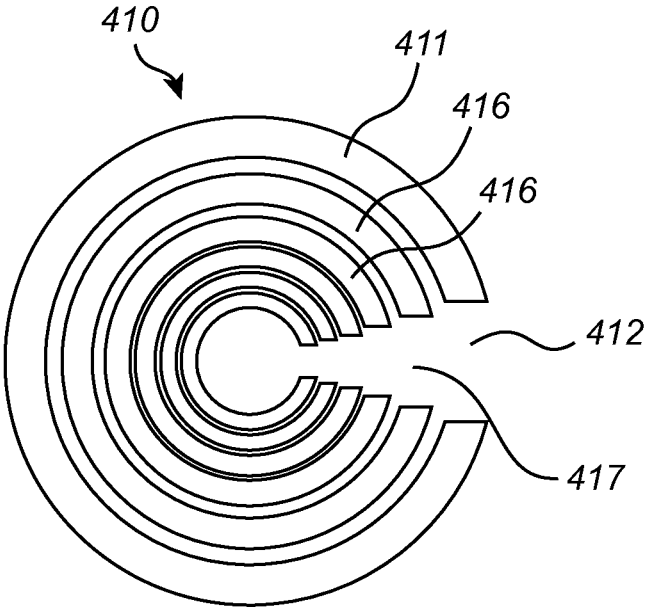
Figure 6:
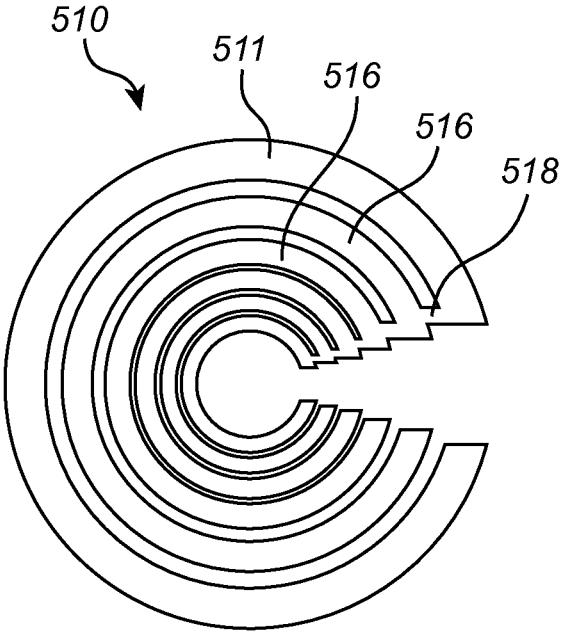

Alternative embodiments of hollow cylindrical elements, for use in room dividers of e.g. the type depicted in FIGS. 1, 2 and 3, will now be described with reference to FIGS. 5 and 6. FIG. 5 shows a hollow cylindrical element 410 similar to the hollow cylindrical elements 110 in FIG. 2, i.e. having a cylindrical shell 411 with a slit 412 facing in a local elongation direction of the room divider (note that the slit 412 may just as well face in a local elongation direction to the left, similarly to the slit 112 in FIG. 2). However, the hollow cylindrical element 410 additionally comprises inner shells 416 arranged concentrically to the cylindrical shell 411. The inner shells 416 comprise respective slits 417 extending along axial directions of the inner shells 416. The slits 417 face the same direction as the slit 412 in cylindrical shell 411. This concentric arrangement of the shells in the hollow cylindrical element 410 allows for resonance in spaces/volumes between the different concentric shells 411, 416. FIG. 6 shows a hollow cylindrical element 510 similar to the hollow cylindrical element 410 depicted in FIG. 5, but where the volumes between the concentric cylinders 511, 516, are closed 518 along one side of the slits.

The different shapes of hollow cylindrical elements (e.g. those depicted in FIGS. 2, 4, 5 and 6), together with the diameter of the hollow cylindrical elements and the lattice constants, make it possible to tune the frequencies where the attenuation peaks of the room divider appear. This flexibility can be used for situations where a certain noise at a particular frequency should be attenuated, e.g. speech, printer noise and air conditioner/purifier noise.

In some example embodiments, one or more hollow cylindrical elements of the room divider may be arranged below and/or on top of a base or platform (as exemplified in FIG. 1 by a platform 150 on which the hollow cylindrical elements 110 are mounted), e.g. for support and/or for facilitating relocation of the room divider. For example, the hollow cylindrical elements may be arranged on a platform with wheels for displacement of the room divider.

Figure 7:
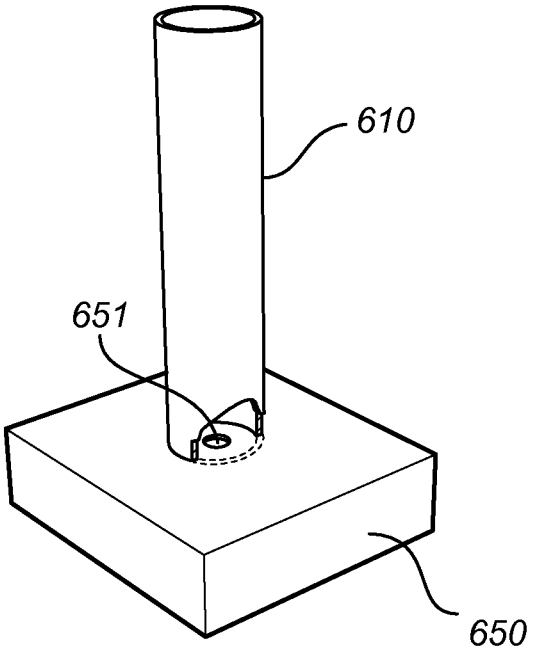
FIG. 7 is a perspective view of a hollow cylindrical element arranged on a base according to an embodiment.

FIG. 7 shows a portion of a room divider with a hollow cylindrical element 610 arranged on a base 650 according to an embodiment (note that the at least one slit of the shell of the hollow cylindrical element 610 is not shown in FIG. 7). The base 650 comprises a cavity and an opening 651 leading into the cavity. For example, the base 650 may comprise a hollow box. The hollow cylindrical element 610 is arranged at the opening 651 of the base 650 in such a way that an interior of a shell of the hollow cylindrical element 610 (e.g. the innermost shell of a hollow cylindrical element of the type depicted in FIG. 5 or 6) is acoustically connected to the cavity via the opening 651. By combining an inner volume of the hollow cylindrical element 610 with the cavity of the base 650, the Helmholtz attenuation/absorption peak caused by resonance in the hollow cylindrical element 610 may be shifted towards lower frequencies. For example, the interiors of at least some of the hollow cylindrical elements of the room divider may be fluidly connected to one or more cavities via holes/openings. Alternatively, the interior of the shells of a hollow cylindrical element may be acoustically connected to the cavity via a membrane covering the opening of the base. Having a membrane or a direct fluid connection for acoustically interconnecting the interior of the hollow cylindrical element and the cavity allows movement of an air mass in the hollow cylindrical element to be transferred to an air mass in the cavity.

The room dividers depicted in FIGS. 1 to 7 may for example have the same height as typical room dividers in open plan offices (e.g. 2 meters) or may extend from floor to ceiling. Any material (e.g. acrylic plastic) may be used to form the hollow cylindrical elements. Preferably, the material of the hollow cylindrical elements may be selected such that there is a substantially total reflection of sound against the hollow cylindrical elements. In some embodiments, a cylindrical shell of a hollow cylindrical element (e.g. one of the concentric shells depicted in FIG. 5 or 6, preferably the innermost of the concentric shells) may be at least partially filled by porous material for broadening the range of frequencies for which resonance (substantially) contributes to the acoustic absorption of the room divider. In some embodiments, one or more perforated panels (e.g. micro-perforated panels) may be arranged to at least partially cover the slits of a cylindrical shell of a hollow cylindrical element (e.g. one of the concentric shells depicted in FIG. 5 or 6, and preferably the innermost of the concentric shells) defining an interface between the interior of the cylinder and the outside air. This inthollow cylindrical elementuces acoustic resistance that may broaden the range of frequencies of sound (substantially) attenuated by the room divider.

Figure 8:
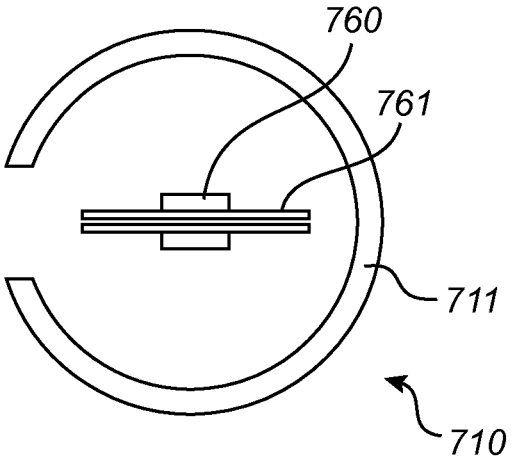
FIG. 8 shows a cross section of a hollow cylindrical element for use in room dividers according to an embodiment.

In some embodiments of the room dividers depicted in FIGS. 1 to 7, lighting may be integrated in the room divider, e.g. to compensate for light obstructed/shadowed by the room divider. FIG. 8 shows a hollow cylindrical element 710 (for use in a room divider) and light sources 760 arranged to emit light out of the hollow cylindrical element 710. In FIG. 8, the light sources 760 are exemplified by two light emitting diodes (LEDs) 760 mounted on circuit boards 761 in the interior of the hollow cylindrical element 710 and adapted to emit light in opposite directions out through the at least partially light transmissive shell 711 of the hollow cylindrical element 710 (i.e. each of the LEDs 760 providing illumination over an angle of approximately 180 degrees). Embodiments are also envisaged in which light sources are mounted at one or more ends of the hollow cylindrical element 710 and/or along strips in the interior of the hollow cylindrical element 710.

In some embodiments, the hollow cylindrical element 710 may be at least partially light transmissive and at least partially diffusive such that visibility through the room divider is controllable by adjusting light emitted by the light sources 760. When the light sources 760 are switched off, the scene behind the room divider may be clearly of diffusely visible. By switching on the light sources 760 (or by increasing the illumination levels of the light sources 760), the scene behind the room divider may be less visible, or even invisible, as light emitted by the light source 760 is coupled out of from the diffusive hollow cylindrical element 710. Thus, enhanced visual privacy for persons on either side of the room divider is created. The hollow cylindrical elements 710 may for example be constructed from PMMA (polymethyl methacrylate) or polycarbonate and may for example be adapted to absorb as little light as possible. Diffusivity of the hollow cylindrical elements 710 may for example be created via microstructures on the inside of the hollow cylindrical elements 710 (i.e. on the inside of the shell 711). The outside of the hollow cylindrical elements 710 is preferably a smooth surface for improving the acoustic functionality of the hollow cylindrical elements 710. The diffusivity may be provided via post processing of the hollow cylindrical elements 710, e.g. by sandblasting or using adhesive foils. Alternatively, the hollow cylindrical elements 710 may for example be created by means of extrusion processing, whereby a microstructure/pattern may be formed on the inner surface of the shell 711. The micro pattern may for example have a pitch in the order of a millimeter or less and may prevent a direct view from one side of the room divider to the other, without substantial amounts of light being absorbed by the room divider. In some embodiments, a diffusing sheet arranged in the hollow cylindrical element 710 may be used for mixing light from multiple LEDs arranged in the hollow cylindrical element 710 such that the individual LED packages are sufficiently concealed and/or hidden from view. For example, LEDs of different colors may be used in the hollow cylindrical element 710 and the light output of the hollow cylindrical element 710 may be color tunable via control of the light output of the individual LEDs.

The use of periodically arranged hollow cylindrical elements as a room divider allows for a modular approach in which individual blocks of the room divider can be made e.g. light transmissive and/or light emissive.

The person skilled in the art realizes that the present invention by no means is limited to the preferred embodiments described above. On the contrary, many modifications and variations are possible within the scope of the appended claims. For example, any of the hollow cylindrical elements depicted in FIGS. 1 to 8 may have additional slits or openings to those depicted in FIGS. 1 to 8. The shells of the hollow cylindrical elements may extend continuously along the perimeter of the corresponding hollow cylindrical element from one side of the at least one slit to another side of the at least one slit, but may have additional slits or holes at other places/locations along the shells, e.g. below and/or above the at least one slit in the case of vertical hollow cylindrical elements. Moreover, additional slits or openings may be present at the ends of the hollow cylindrical elements, e.g. where the hollow cylindrical elements are mounted. The at least one slit may for example extend along the entire axial length of a hollow cylindrical element, or may extend only partway along the axial length of a hollow cylindrical element.

Additionally, variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage. Any reference signs in the claims should not be construed as limiting the scope.

The invention claimed is:

1. A room divider for dividing at least a portion of a room into two sub-portions and for attenuating sound travelling between the two sub-portions, the room divider comprising a plurality of hollow cylindrical elements arranged periodically for dividing said portion of the room into said two sub-portions, wherein each hollow cylindrical element has a cylindrical shell comprising a slit that extends in an axial direction of the cylindrical shell, the cylindrical shell extending continuously along the perimeter of the hollow cylindrical element from one side of the slit to another side of the slit, and the slit facing in a local elongation direction of the room divider, and wherein the room divider further comprises a light source arranged to emit light out of at least one of the hollow cylindrical elements, wherein the room divider further comprises a rail, wherein at least one of the hollow cylindrical elements is movably arranged along the rail.

2. The room divider as defined in claim 1, wherein the cylindrical shell is arranged to extend continuously along the two portions of the perimeter of the hollow cylindrical element facing said two sub-portions.

3. The room divider as defined in claim 1, wherein the hollow cylindrical elements are arranged in two rows.

4. The room divider as defined in claim 1, wherein the hollow cylindrical elements are spatially spaced from each other.

5. The room divider as defined in claim 1, comprising straight passages between the hollow cylindrical elements, the passages extending between opposite sides of the room divider, and the passages being adapted to connect said sub-portions to allow light to pass through the room divider.

6. The room divider as defined in claim 1, wherein at least some of the hollow cylindrical elements have an inner shell arranged concentrically to the cylindrical shell.

7. The room divider as defined in claim 1, wherein at least one of the hollow cylindrical elements is at least partially light transmissive.

8. The room divider as defined in claim 1, wherein the light source is arranged at an end of one of the at least one hollow cylindrical element and adapted to emit light towards an interior of said at least one hollow cylindrical element.

9. The room divider as defined in claim 1, wherein the light source is a strip of light sources arranged along said axial direction in an interior of a shell of the at least one hollow cylindrical element.

10. The room divider as defined in claim 1, wherein at least some of the hollow cylindrical elements are at least partially light transmissive and at least partially light diffusive such that visibility through the room divider is controllable by adjusting light emitted by the light source.

11. A room divider for dividing at least a portion of a room into two sub-portions and for attenuating sound travelling between the two sub-portions, the room divider comprising a plurality of hollow cylindrical elements arranged periodically for dividing said portion of the room into said two sub-portions, wherein at least one of the hollow cylindrical elements has a cylindrical shell comprising two slits facing in opposite local elongation directions of the room divider, and wherein the cylindrical shell extends continuously between the two slits along the perimeter of the hollow cylindrical element, wherein the room divider further comprises a light source arranged to emit light out of at least one of the hollow cylindrical elements.

12. The room divider as defined in claim 11, wherein the hollow cylindrical elements are spatially spaced from each other.

13. The room divider as defined in claim 11, wherein at least one of the hollow cylindrical elements is at least partially light transmissive.

14. The room divider as defined in claim 11, wherein at least some of the hollow cylindrical elements are at least partially light transmissive and at least partially light diffusive such that visibility through the room divider is controllable by adjusting light emitted by the light source.

15. A room divider for dividing at least a portion of a room into two sub-portions and for attenuating sound travelling between the two sub-portions, the room divider comprising a plurality of hollow cylindrical elements arranged periodically for dividing said portion of the room into said two sub-portions, and a base with a cavity and an opening leading into the cavity, at least one of the hollow cylindrical elements being arranged at the opening of the base in such a way that an interior of a shell of the at least one hollow cylindrical element is acoustically connected to the cavity via the opening, wherein each hollow cylindrical element has a cylindrical shell comprising a slit that extends in an axial direction of the cylindrical shell, the cylindrical shell extending continuously along the perimeter of the hollow cylindrical element from one side of the slit to another side of the slit, and the slit facing in a local elongation direction of the room divider, and wherein the room divider further comprises a light source arranged to emit light out of at least one of the hollow cylindrical elements.

16. The room divider as defined in claim 15, wherein the hollow cylindrical elements are spatially spaced from each other.

17. The room divider as defined in claim 15, wherein at least one of the hollow cylindrical elements is at least partially light transmissive.

18. The room divider as defined in claim 15, wherein at least some of the hollow cylindrical elements are at least partially light transmissive and at least partially light diffusive such that visibility through the room divider is controllable by adjusting light emitted by the light source.

* * * * *